US008366969B2

(12) United States Patent
Wu

(10) Patent No.: US 8,366,969 B2
(45) **Date of Patent: *Feb. 5, 2013**

(54) PHOSPHATE ESTER POLYAMIDEIMIDE MIXTURE CONTAINING INTERMEDIATE TRANSFER MEMBERS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 83 days.

This patent is subject to a terminal disclaimer.

(21) Appl. No.: 12/869,103

(22) Filed: Aug. 26, 2010

(65) Prior Publication Data

US 2012/0049122 A1 Mar. 1, 2012

(51) Int. Cl.
*H01B 1/22* (2006.01)

(52) U.S. Cl. ..... 252/500; 252/511; 252/519.33; 399/302; 428/35.5; 528/353

(58) Field of Classification Search ..... 252/500, 252/519.33; 399/302; 428/35.5; 528/353
See application file for complete search history.

(56) References Cited

U.S. PATENT DOCUMENTS

| | | | | |
|---|---|---|---|---|
| 5,487,707 | A | 1/1996 | Sharf et al. | |
| 6,139,784 | A | 10/2000 | Oshima et al. | |
| 6,318,223 | B1 | 11/2001 | Yu et al. | |
| 6,397,034 | B1 | 5/2002 | Tarnawskyj et al. | |
| 6,440,515 | B1 | 8/2002 | Thornton et al. | |
| 6,602,156 | B2 | 8/2003 | Schlueter, Jr. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 2007/0178264 | A1* | 8/2007 | Nishiura et al. | 428/35.5 |
| 2008/0020313 | A1* | 1/2008 | Wu et al. | 430/69 |
| 2008/0057351 | A1* | 3/2008 | Meguro et al. | 428/840 |
| 2009/0297232 | A1 | 12/2009 | Wu | |

OTHER PUBLICATIONS

U.S. Appl. No. 12/413,638, filed Mar. 30, 2009.
U.S. Appl. No. 12/608,683, filed Oct. 29, 2009.
U.S. Patent Application No. filed concurrently herewith.

* cited by examiner

*Primary Examiner* — Gregory Listvoyb
(74) *Attorney, Agent, or Firm* — Eugene O. Palazzo

(57) ABSTRACT

An intermediate transfer media, such as a belt, that includes for example, a polyamideimide, a phosphate ester and a conductive component, like carbon black.

6 Claims, No Drawings

PHOSPHATE ESTER POLYAMIDEIMIDE MIXTURE CONTAINING INTERMEDIATE TRANSFER MEMBERS

CROSS REFERENCES TO RELATED APPLICATIONS

U.S. application Ser. No. 12/608,683, filed Oct. 29, 2009, the disclosure of which is totally incorporated herein by reference, illustrates an intermediate transfer member comprised of a phosphate ester, and a polymeric binder and which phosphate esters can be selected for the intermediate transfer members of the present disclosure in embodiments thereof.

U.S. application Ser. No. 12/869,119 filed concurrently herewith, the disclosure of which is totally incorporated herein by reference, discloses an intermediate transfer member comprised of phosphate ester modified polyimide generated from the esterification reaction product of a phosphate ester, and a polyamic acid and which member includes a conductive component.

Copending U.S. application Ser. No. 12/413,638 filed Mar. 30, 2009, entitled Perfluoropolyether Polymer Grafted Polyaniline Containing Intermediate Transfer Members illustrates an intermediate transfer member comprised of a substrate and in contact with the substrate a polyaniline grafted perfluoropolyether phosphoric acid polymer.

Illustrated in U.S. application Ser. No. 12/129,995, filed May 30, 2008, entitled Polyimide Intermediate Transfer Components, the disclosure of which is totally incorporated herein by reference, is an intermediate transfer belt comprised of a substrate comprising a polyimide and a conductive component wherein the polyimide is cured at a temperature of from about 175 to about 290° C. over a period of time of for example, from about 10 to about 120 minutes.

BACKGROUND

Disclosed are intermediate transfer members, and more specifically, intermediate transfer members useful in transferring a developed image in an electrostatographic, for example xerographic, including digital, image on image, and the like, machines or apparatuses, and printers, inclusive of office and production printers. In embodiments, there are selected intermediate transfer members comprised of a mixture of a phosphate ester and a polyamideimide (PAI), each of these two components being commercially available. In embodiments thereof, the phosphate ester and PAI may be dispersed in or mixed with a suitable polymer, such as those illustrated herein, like a polyimide or a polycarbonate.

A number of advantages are associated with the intermediate transfer members, such as belts (ITB) of the present disclosure, such as excellent acceptable resistivity, a high modulus, for example 5,000 MPa, such as from about 5,000 to about 7,000 MPa, and which coating mixture after being applied to a substrate, such as a metal substrate, possesses self release characteristics from the metal substrate that is for example, the coating mixture can be easily removed from substrates either automatically or by simple hand peeling; and weldable intermediate transfer belts that may not, but could, have puzzle cut seams, and instead, has a weldable seam, thereby providing a belt that can be manufactured without labor intensive steps, such as manually piecing together the puzzle cut seam with fingers, and without the lengthy high temperature and high humidity conditioning steps.

In a typical electrostatographic reproducing apparatus, such as xerographic copiers, printers, multifunctional machines, and the like a light image of an original to be copied is recorded in the form of an electrostatic latent image upon a photosensitive member or a photoconductor, and the latent image is subsequently rendered visible by the application of electroscopic thermoplastic resin particles and colorant. Generally, the electrostatic latent image is developed by contacting it with a developer mixture comprised of carrier granules having toner particles adhering triboelectrically thereto, or a liquid developer material, which may include a liquid carrier having toner particles dispersed therein. The developer mixture is advanced into contact with the electrostatic latent image, and the toner particles are deposited thereon in image configuration. Subsequently, the developed image is transferred to a document, such as paper and fixed or fused by for example heat and pressure. It is advantageous in some instances to transfer the developed image to a intermediate transfer web, belt or component, and thereafter, transfer with a high, for example about 90 to about 100, transfer efficiency the developed image from the intermediate transfer member to a substrate, like paper, cardboard, transparencies, and the like.

There has been disclosed in several U.S. patents that intermediate transfer members enable acceptable registration of the final color toner image in color systems using synchronous development of one or more component colors, and using one or more transfer stations. However, a disadvantage of using an intermediate transfer member is that a plurality of developed toner transfer operations is utilized thus sometimes causing charge exchange between the toner particles and the transfer member, which ultimately can result in less than complete toner transfer, resulting in low resolution images on the image receiving substrate, like paper, and image deterioration. When the image is in color, the image can additionally suffer from color shifting and color deterioration.

In embodiments, it is desired to provide an intermediate transfer member, which has excellent transfer capabilities; is conductive, and more specifically, has excellent conductivity or resistivity as compared, for example, to an intermediate transfer member where a phosphate ester and a polyamideimide (PAI) is absent; and possesses excellent humidity insensitivity characteristics leading to developed images with minimal resolution issues, and where the mixture of the phosphate ester and the PAI can be easily removed from substrates either automatically or by simple hand peeling. It is also desired to provide a weldable intermediate transfer belt that may not, but could, have puzzle cut seams, and instead, has a weldable seam, thereby providing a belt that can be manufactured without labor intensive steps, such as manually piecing together the puzzle cut seam with fingers, and without the lengthy high temperature and high humidity conditioning steps. It is also desired to provide an intermediate transfer member, which has excellent wear and abrasion resistance, and more specifically, has excellent mechanical properties as compared, for example, to an intermediate transfer member where a phosphate ester and the polymeric binder are absent.

REFERENCES

Illustrated in U.S. Pat. No. 7,031,647 is an imageable seamed belt containing a lignin sulfonic acid doped polyaniline.

Disclosed in U.S. Pat. No. 6,397,034 polyimide intermediate transfer member layer treated with a carbon black filler.

Illustrated in U.S. Pat. No. 7,139,519 is an intermediate transfer belt comprising a belt with a welded seam comprising primarily a polyimide polymer.

Illustrated in U.S. Pat. No. 7,130,569 is a weldable intermediate transfer belt comprising a substrate comprising a homogeneous composition comprising a polyaniline in an amount of, for example, from about 2 to about 25 percent by weight of total solids, and a thermoplastic polyimide present in an amount of for example, from about 75 to about 98 percent by weight of total solids, wherein the polyaniline has a particle size diameter of, for example, from about 0.5 to about 5 microns.

Puzzle cut seam members are disclosed in U.S. Pat. Nos. 5,487,707; 6,318,223, and 6,440,515.

Illustrated in U.S. Pat. No. 6,602,156 is a polyaniline filled polyimide puzzle cut seamed belt.

Disclosed in U.S. Pat. No. 6,139,784 is a seamless belt containing a conductive powder and a polyimide resin, and more specifically, processes for the preparation of seamless belts.

SUMMARY

In embodiments, there is disclosed an intermediate transfer member comprised of a substrate comprising a mixture of a conductive component like carbon black, a phosphate ester and a polyamideimide (PAI); an intermediate transfer member, such as an intermediate belt comprised of a supporting substrate such as a polyimide, and a layer thereover comprising a phosphate ester, a conductive component like carbon black, and PAL; an intermediate transfer member wherein the resisitivity thereof, as measured with a known High Resisitivity Meter, is for example, from about $10^8$ to about $10^{13}$ ohm/square, from about $10^9$ to about $10^{12}$ ohm/square, and more specifically, from about $10^{19}$ to about $10^{11}$ ohm/square; an excellent maintained resistivity for extended time periods; excellent wear and abrasion resistance; and self releasing characteristics of the phosphate ester, PAI, and conductive component coating from a metal substrate.

In addition, the present disclosure provides, in embodiments, an apparatus for forming images on a recording medium comprising a charge retentive surface with an electrostatic latent image thereon; a development component to apply toner to the charge retentive surface; and the intermediate transfer member disclosed herein for transfer of the developed image from the charge retentive surface; and atoner fixing by heat, pressure or heat and pressure.

EMBODIMENTS

Aspects of the present disclosure relate to an intermediate transfer member comprised of a phosphate ester, a polyamideimide, and a conductive component; an intermediate transfer belt comprised of a polyamideimide, a phosphate ester selected from the group consisting of an alkyl alcohol ethoxylate phosphate, an alkyl phenol ethoxylate phosphate, an alkyl polyethoxyethanol phosphate, an alkylphenoxy polyethoxyethanol phosphate or in embodiments mixtures thereof, each present in an amount of from about 0.1 to about 4 weight percent, and carbon black and wherein the polyamideimide is present in an amount of from about 60 to about 97 weight percent, and the carbon black is present in an amount of from about 3 to about 40 weight percent, and the total thereof is about 100 percent; an intermediate transfer member comprised of a mixture of a polyamideimide, a phosphate ester and a conductive component, wherein the phosphate ester is selected from the group consisting of an alkyl alcohol ethoxylate phosphate, an alkyl phenol ethoxylate phosphate, an alkyl polyethoxyethanol phosphate, and an alkylphenoxy polyethoxyethanol phosphate; the conductive component is a carbon black, a metal oxide, or a polyaniline; and the polyamideimide is selected from the group consisting one of the following formulas/structures where n represents the number of repeating segments of for example, from about 20 to about 1,000 from about 100 to about 750, from about 300 to about 700, from about 200 to about 500:

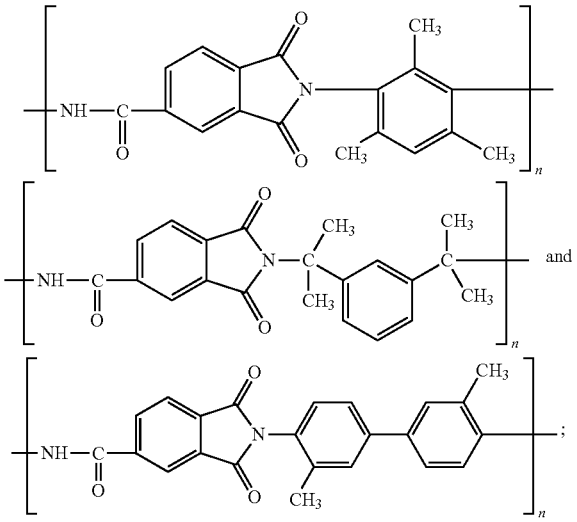

an intermediate transfer member comprised of a phosphate ester, a polyamideimide, carbon black, and an optional polymeric binder; an intermediate transfer member comprised of an optional supporting substrate, and a mixture of a conductive component, a phosphate ester and PAI, wherein the phosphate ester is for example, an alkyl alcohol ethoxylate phosphate, an alkyl phenol ethoxylate phosphate, an alkyl polyethoxyethanol phosphate, an alkylphenoxy polyethoxyethanol phosphate, or mixtures thereof, the conductive component is for example, a carbon black, a metal oxide, a polyaniline, and other known suitable conductive components, and the PAI is a polyamideimide as illustrated herein, such as VYLOMAX® HR-11NN (15 weight percent of PAI in a solution formed with a solvent, like NMP, and with a $T_g$=300° C.); HR-16NN (14 weight percent PAI solution in NMP, $T_g$=320° C.) and HR-66NN (13 weight percent PAI solution in NMP, $T_g$=340° C.), all available from Toyobo Industries of Japan; an intermediate transfer belt comprised of a PAI, a carbon black, and a phosphate ester that functions primarily as a release agent, and an optional polymeric binder, wherein the phosphate ester is an alkyl alcohol ethoxylate phosphate, an alkyl phenol ethoxylate phosphate, an alkyl polyethoxyethanol phosphate, or an alkylphenoxy polyethoxyethanol phosphate, and the polymeric binder is a polyimide, a polycarbonate, a polyamideimide, a polyphenylene sulfide, a polyimide, a polysulfone, a polyetherimide, a polyester, a polyvinylidene fluoride, or a polyethylene-co-polytetrafluoroethylene, and where the ratio amount of the phosphate ester to the PAI is between about 0.1/99.9 and about 4/96; a transfer media comprised of a mixture of a carbon black, a phosphate ester, and a PAI; and an apparatus for forming images on a recording medium comprising a charge retentive surface with an electrostatic latent image thereon; a development component to apply toner to the charge retentive surface, the intermediate transfer member illustrated herein and more specifically where the phosphate ester release agent is an alkyl alcohol alkoxylate phosphate, an alkyl phenol alkoxylate phosphate, an alkyl polyalkoxyethanol phosphate, an alkylphenoxy polyalkoxyethanol phosphate, or mixtures thereof, where alkoxy contains for example, from 1 to about 16 carbon atoms, and alkyl contains for example, from about 1 to about 36 carbon atoms, where the ratio of the PAI binder to the conductive component, like carbon black to the phosphate ester is, for example, 85/14.9/0.1, 95/4.5/0.5, 79/20/1, or 78/18/4 where the ratios are determined by known methods and more specifically where the ratios are calculated based on the initial feed amounts of each of the components.

Examples of phosphate esters, available for example, from STEPAN Company, Northfield, Ill., selected for the intermediate transfer member mixture include a number of known phosphate esters, and more specifically, where the phosphate ester is a phosphate ester of alkyl alcohol alkoxylate such as alkyl alcohol ethoxylate, alkyl phenol alkoxylate such as alkyl phenol ethoxylate, alkyl polyethoxyethanol such as alkyl polyalkoxyethanol, alkylphenoxy polyalkoxyethanol such as alkylphenoxy polyethoxyethanol, mixtures thereof, and corresponding alkoxy esters wherein alkyl and alkoxy contain, for example, from 1 to about 36 carbon atoms, from 1 to about 18 carbon atoms, from 1 to about 12 carbon atoms, from 1 to about 6 carbon atoms, optionally mixtures thereof, and the like. In embodiments the number average molecular weight of the phosphate ester is for example, from about 200 to about 2,000, from about 500 to about 1,000, from about 300 to about 800; and the weight average molecular weight of the phosphate ester is for example, from about 250 to about 8,000, from about 1,000 to about 5,000 or from about 400 to about 2,000.

Phosphate esters of alkyl alcohol ethoxylate examples include POLYSTEP® P-11, P-12 and P-13 (tridecyl alcohol ethoxylate phosphate, available from STEPAN Company, Northfield, Ill.) with an average mole number of ethoxy (EO) of about 3, 6 and 12, respectively. The average mole number of ethoxy can be determined by known methods and more specifically for example, with a single phosphate ester, like POLYSTEP® P-11 which has three ethoxys (EO) [—$CH_2CH_2O$—$CH_2CH_2O$—$CH_2CH_2O$—] in its structure; the higher the mole number of EO, the higher the molecular weight of the phosphate ester. Specific examples of phosphate esters present in the amounts illustrated herein are an alkyl, with for example, from 1 to about 25 carbon atoms, alcohol ethoxylate like trioctyl alcohol ethoxylate phosphate, trihexyl alcohol ethoxylate phosphate, triheptyl alcohol ethoxylate phosphate or tripentyl alcohol ethoxylate phosphate.

Examples of phosphate esters of alkyl phenol ethoxylates include POLYSTEP® P-31, P-32, P-33, P-34 and P-35 (nonylphenol ethoxylate phosphate, available from STEPAN Company, Northfield, Ill.) with for example, an average mole number of ethoxy (EO) of about 4, 6, 8, 10 and 12, respectively. Other examples of phosphate esters of alkyl phenol ethoxylates include octylphenol ethoxylate phosphate, hexylphenol ethoxylate phosphate, decylphenol ethoxylate phosphate, or heptylphenol ethoxylate phosphate.

Examples of phosphate esters of alkyl polyethoxyethanol include STEPFAC™ 8180, 8181 and 8182 (polyethylene glycol tridecyl ether phosphate, available from STEPAN Company, Northfield, Ill.) with an average mole number of ethoxy (EO) of about 3, 6 and 12, respectively. Other examples of phosphate esters of alkyl polyethoxyethanol include polyethylene glycol trioctyl ether phosphate, polyethylene glycol triheptyl ether phosphate, polyethylene glycol trihexyl ether phosphate, or polyethylene glycol tripentyl ether phosphate.

Examples of phosphate esters of alkylphenoxy polyethoxyethanol include STEPFAC™ 8170, 8171, 8172, 8173, 8175 (nonylphenol ethoxylate phosphate, available from STEPAN Company, Northfield, Ill.) with an average mole number of ethoxy (EO) of about 10, 6, 4, 8 and 12, respectively; phosphate esters of alkylphenoxy polyethoxyethanol include octylphenol ethoxylate phosphate, decylphenol ethoxylate phosphate, heptylphenol ethoxylate phosphate, or hexylphenol ethoxylate phosphate.

Various amounts of phosphate esters can be selected for the intermediate transfer members disclosed herein, such as for example, from about 0.1 to about 10 weight percent, from about 0.1 to about 5 weight percent, from about 0.1 to about 4 weight percent, from 0.2 to about 3 weight percent, from 0.5 to about 2 weight percent, from about 1 to about 4 weight percent based on the percentage of components present in the member of the polyamideimide, the phosphate ester and the conductive component.

Polyamideimide examples selected for the disclosed intermediate transfer members include for example, those polymers represented by the following structures/formulas and available from Toyobo Company, Japan, where n represents the number of repeating segments and is for example, a number of from about 20 to about 1,000, from about 50 to about 750, from about 125 to about 500, from about 150 to about 400, from about 200 to about 600, from about 500 to about 700, or more specifically from about 100 to about 500; and Ar is an aryl with for example, from about 6 to about 36 carbon atoms, from about 6 to about 24 carbon atoms, from about 6 to about 18 carbon atoms, from about 6 to about 12 carbon atoms, or 6 carbon atoms

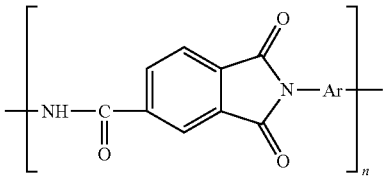

where the number average molecular weight of the polyamideimide is for example from about 5,000 to 50,000, from about 10,000 to about 25,000, from about 15,000 to about 35,000, or from about 7,000 to about 20,000, and the weight average molecular weight of the polyamideimide is for example from about 10,000 to 200,000, from about 50,000 to about 325,000, from about 100,000 to about 300,000 or from about 30,000 to about 100,000 as determined by known methods, such as GPC analysis.

Specific polyamideimide examples can be represented by at least one of

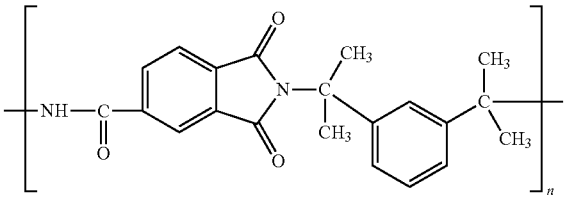

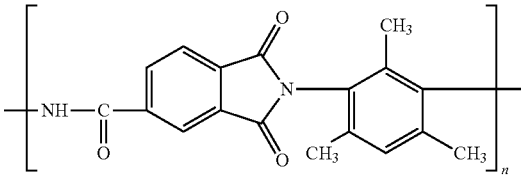

-continued

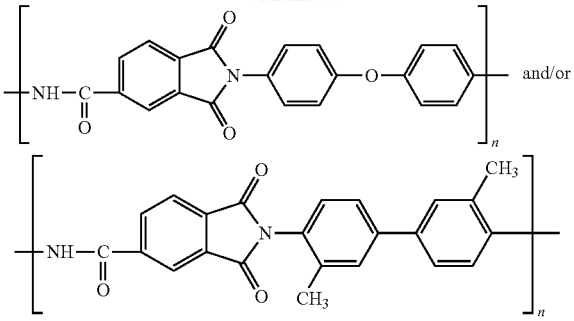

where n represents the number of repeating segments and is for example, as illustrated herein such as n being a number of from about 20 to about 1,000, or from about 100 to about 500.

In embodiments, the polyamideimides commercially available from Toyobo Company can be synthesized by at least the following two known methods: (1) the isocyanate method which involves the reaction between an isocyanate and trimellitic anhydride; or (2) the acid chloride method where there is reacted a diamine and trimellitic anhydride chloride. Thus, with the first method, (1), when more than one, such as two, three or four, isocyanates are selected to react with a trimellitic anhydride, a polyamideimide copolymer is formed, and which copolymer can be included in the intermediate transfer member; and with (2) when more than one, such as two or three acid chlorides are selected to react with a trimellitic anhydride chloride, a polyamideimide copolymer is formed, and which copolymer can also be included in the disclosed intermediate transfer member. Additionally, polyamideimide homopolymers, polyamideimide copolymers and their blends can also be included in the disclosed intermediate transfer members disclosed herein.

Commercially available or obtainable examples of the polyamideimides include VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and M=100,000), HR-66NN (13 weight percent solution in N-methylpyrrolidone, $T_g$=340° C.), all commercially available from Toyobo Company of Japan, and TORLON® AI-10 ($T_g$=272° C.), commercially available from Solvay Advanced Polymers, LLC, Alpharetta, Ga.

The conductive material or component, such as a carbon black, a metal oxide or a polyaniline, is present in the coating mixture in, for example, an amount of from about 1 to about 60 weight percent, from about 3 to about 40 weight percent, from about 10 to about 30 percent or from about 5 to about 20 weight percent.

The conductivity of carbon black is dependent on its surface area and its structure primarily. Generally, the higher the surface area and the higher the structure, the more conductive is the carbon black. Surface area is measured by the B.E.T. nitrogen surface area per unit weight of carbon black, and is the measurement of the primary particle size. Structure is a complex property that refers to the morphology of the primary aggregates of carbon black. It is a measure of both the number of primary particles comprising primary aggregates, and the manner in which they are "fused" together. High structure carbon blacks are characterized by aggregates comprised of many primary particles with considerable "branching" and "chaining", while low structure carbon blacks are characterized by compact aggregates comprised of fewer primary particles. Structure is measured by dibutyl phthalate (DBP) absorption by the voids within carbon blacks. The higher the structure, the more the voids, and the higher the DBP absorption.

Examples of carbon blacks selected as the conductive component for the intermediate transfer mixture containing the phosphate ester and the PAI include VULCAN® carbon blacks, REGAL® carbon blacks, MONARCH® carbon blacks and BLACK PEARLS® carbon blacks available from Cabot Corporation. Specific examples of conductive carbon blacks are BLACK PEARL® 1000 (B.E.T. surface area=343 $m^2$/g, DBP absorption=1.05 ml/g), BLACK PEARLS® 880 (B.E.T. surface area=240 $m^2$/g, DBP absorption=1.06 ml/g), BLACK PEARLS® 800 (B.E.T. surface area=230 $m^2$/g, DBP absorption=0.68 ml/g), BLACK PEARLS® L (B.E.T. surface area=138 $m^2$/g, DBP absorption=0.61 ml/g), BLACK PEARLS® 570 (B.E.T, surface area=110 $m^2$/g, DBP absorption=1.14 ml/g), BLACK PEARLS® 170 (B.E.T. surface area=35 $m^2$/g, DBP absorption=1.22 ml/g), VULCAN® XC72 (B.E.T. surface area=254 $m^2$/g, DBP absorption=1.76 ml/g), VULCAN® XC72R (fluffy form of VULCAN® XC72), VULCAN® XC605, VULCAN® XC305, REGAL° 660 (B.E.T. surface area=112 $m^2$/g, DBP absorption=0.59 ml/g), REGAL® 400 (B.E.T. surface area=96 $m^2$/g, DBP absorption=0.69 ml/g), REGAL® 330 (B.E.T. surface area=94 $m^2$/g, DBP absorption=0.71 ml/g), MONARCH° 880 (B.E.T. surface area=220 $m^2$/g, DBP absorption=1.05 ml/g, primary particle diameter=16 nanometers), and MONARCH® 1000 (B.E.T. surface area=343 $m^2$/g, DBP absorption=1.05 ml/g, primary particle diameter=16 nanometers); Channel carbon blacks available from Evonik-Degussa; Special Black 4 (B.E.T. surface area=180 $m^2$/g, DBP absorption=1.8 ml/g, primary particle diameter=25 nanometers), Special Black 5 (B.E.T. surface area=240 $m^2$/g, DBP absorption=1.41 ml/g, primary particle diameter=20 nanometers), Color Black FW1 (B.E.T. surface area=320 $m^2$/g, DBP absorption=2.89 ml/g, primary particle diameter=13 nanometers), Color Black FW2 (B.E.T. surface area=460 $m^2$/g, DBP absorption=4.82 ml/g, primary particle diameter=13 nanometers), and Color Black FW200 (B.E.T. surface area=460 $m^2$/g, DBP absorption=4.6 ml/g, primary particle diameter=13 nanometers). Other known suitable carbon blacks not specifically disclosed herein may be selected as the conductive component for the intermediate transfer member disclosed herein.

In embodiments, the polyaniline conductive component selected for incorporation into the intermediate transfer members (ITM) disclosed herein are PANIPOL™ F, commercially available from Panipol Oy, Finland; and known lignosulfonic acid grafted polyanilines. These polyanilines usually have a relatively small particle size diameter of, for example, from about 0.5 to about 5 microns, from about 1.1 to about 2.3 microns, from about 1.2 to about 2 microns, from about 1.5 to about 1.9 microns, or about 1.7 microns.

Examples of metal oxides selected as a conductive component for the disclosed intermediate transfer members include for example, tin oxide, antimony doped tin oxide, indium oxide, indium tin oxide, zinc oxide, and titanium oxide and the like.

With known milling processes, uniform dispersions of the intermediate transfer member mixture can be obtained, and then coated on a metal substrate such as a stainless steel using a draw bar coating method. The resulting individual film or films can be dried at high temperatures, such as by heating of from about 100 to about 400° C., or from about 160 to about 300° C., for a suitable period of time, such as from about 20 to about 180 minutes, or from about 40 to about 120 minutes, while remaining on the separate metal substrates. After drying and cooling to room temperature, about 23 to about 25° C., the films on the metal substrates release from the substrates automatically, and there results for example, in embodiments, from about 50 to about 150 micron thick films that function as intermediate transfer members.

As metal substrates, there can be selected stainless steel, aluminum, nickel, copper, and their alloys, and such substrates it can be in the form of a flexible belt or a rigid drum.

In embodiments of the present disclosure the phosphate ester can be mixed and ball milled together with the conductive component, and the PAI in a solvent, like N-methyl-2-pyrrolidone (NMP) to form a dispersion thereof, and then the resulting dispersion mixture can be applied to or coated on a metal substrate or a glass plate using known draw bar coating methods. The resulting film or films can be dried in an oven at high temperatures, such as from about 100 to about 400° C., from about 125 to about 300° C., or from about 175 to about 200° C. for a sufficient period of time, such as for example, from about 10 to about 180 minutes, from about 20 to about 125 minutes, or from about 40 to about 100 minutes while remaining on the metal substrate or the glass plate. After drying and cooling to room temperature, the about 50 to about 150 microns thick film or films formed are released almost instantly, that is for example, in about 3 to about 5 seconds from the metal or the glass plate without any tools and with simple hand peeling.

Examples of solvents selected, in an amount for example, of from about 60 to about 95 weight percent, from about 70 to about 90 weight percent of the total coating dispersion for the phosphate ester, conductive component, polyamideimide, mixture include, for example, alkylene halides such as methylene chloride, tetrahydrofuran, toluene, monochlorobenzene, N-methyl-2-pyrrolidone, N,N-dimethylformamide, N,N-dimethylacetamide, methyl ethyl ketone, methyl isobutyl ketone, mixtures thereof, and the like.

In embodiments the phosphate ester, the polyamideimide, and the conductive component, especially after release from the metal substrates illustrated herein, can be coated on a supporting substrate, such as a polyimide, a polyamideimide, a polyetherimides, and mixtures thereof.

More specifically, examples of the intermediate transfer member supporting substrates of a thickness, for example, of from about 10 to about 300 microns, from 50 to about 150 microns, from 75 to about 125 microns, are polyimides inclusive of known low temperature, and rapidly cured polyimide polymers, such as VTEC™ PI 1388, 080-051, 851, 302, 203, 201, and PETI-5, all available from Richard Blaine International, Incorporated, Reading, Pa. These thermosetting polyimides can be cured at temperatures of from about 180 to about 260° C. over a short period of time, such as from about 10 to about 120 minutes, or from about 20 to about 60 minutes; possess a number average molecular weight of from about 5,000 to about 500,000, or from about 10,000 to about 100,000, and a weight average molecular weight of from about 50,000 to about 5,000,000, or from about 100,000 to about 1,000,000. Also, for the supporting substrate there can be selected thermosetting polyimides that can cured at temperatures of above 300° C., such as PYRE M.L.® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN and FN, all commercially available from E.I. DuPont, Wilmington, Del.

Examples of polyamideimides that can be selected as supporting substrates are VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON® AI-10 ($T_g$=272° C.), commercially available from Solvay Advanced Polymers, LLC, Alpharetta, Ga.

Examples of polyetherimide supporting substrates are ULTEM® 1000 ($T_g$=210° C.), 1010 ($T_g$=217° C.), 1100 ($T_g$=217° C.), 1285, 2100 ($T_g$=217° C.), 2200 ($T_g$=217° C.), 2210 ($T_g$=217° C.), 2212 ($T_g$=217° C.), 2300 ($T_g$=217° C.), 2310 ($T_g$=217° C.), 2312 ($T_g$=217° C.), 2313 ($T_g$=217° C.), 2400 ($T_g$=217° C.), 2410 ($T_g$=217° C.), 3451 ($T_g$=217° C.), 3452 ($T_g$=217° C.), 4000 ($T_g$=217° C.), 4001 ($T_g$=217° C.), 4002 ($T_g$=217° C.), 4211 ($T_g$=217° C.), 8015, 9011 ($T_g$=217° C.), 9075, and 9076, all commercially available from Sabic Innovative Plastics.

The disclosed intermediate transfer members are, in embodiments, weldable, that is the seam of the member like a belt is weldable, and more specifically, may be ultrasonically welded to produce a seam. The surface resistivity of the disclosed intermediate transfer member is, for example, from about $10^9$ to about $10^{13}$ ohm/square, or from about $10^{10}$ to about $10^{12}$ ohm/square. The sheet resistivity of the intermediate transfer weldable member is, for example, from about $10^9$ to about $10^{13}$ ohm/square, or from about $10^{10}$ to about $10^{12}$ ohm/square.

The intermediate transfer members illustrated herein like intermediate transfer belts can be selected for a number of printing and copying systems, inclusive of xerographic printing systems. For example, the disclosed intermediate transfer members can be incorporated into a multi-imaging xerographic machine where each developed toner image to be transferred is formed on the imaging or photoconductive drum at an image forming station, and where each of these images is then developed at a developing station, and transferred to the intermediate transfer member. The images may be formed on a photoconductor and developed sequentially, and then transferred to the intermediate transfer member. In an alternative method, each image may be formed on the photoconductor or photoreceptor drum, developed, and then transferred in registration to the intermediate transfer member. In an embodiment, the multi-image system is a color copying system, wherein each color of an image being copied is formed on the photoreceptor drum, developed, and transferred to the intermediate transfer member.

After the toner latent image has been transferred from the photoreceptor drum to the intermediate transfer member, the intermediate transfer member may be contacted under heat and pressure with an image receiving substrate such as paper. The toner image on the intermediate transfer member is then transferred and fixed, in image configuration, to the substrate such as paper.

The intermediate transfer member present in the imaging systems illustrated herein, and other known imaging and printing systems may be in the configuration of a sheet, a web, a belt, including an endless belt, and an endless seamed flexible belt; a roller, a film, a foil, a strip, a coil, a cylinder, a drum, an endless strip, and a circular disc. The intermediate transfer member can be comprised of a single layer, or can be comprised of several layers, such as from about 2 to about 5 layers. The circumference of the intermediate transfer member, especially as it is applicable to a film or a belt configuration, is, for example, from about 275 to about 2,700 millimeters, from about 1,700 to about 2,600 millimeters, or from about 2,000 to about 2,200 millimeters with a corresponding width of, for example, from about 100 to about 1,000 millimeters, from about 200 to about 500 millimeters, or from about 300 to about 400 millimeters.

In embodiments, the intermediate transfer member further includes an outer release layer. Release layer examples situated on and in contact with the phosphate ester, polyamideimide, conductive mixture include TEFLON®-like materials including fluorinated ethylene propylene copolymer (FEP), polytetrafluoroethylene (PTFE), polyfluoroalkoxy polytetrafluoroethylene (PFA TEFLON®), and other TEFLON®-like materials; silicone materials, such as fluorosilicones and silicone rubbers, such as Silicone Rubber 552, available from Sampson Coatings, Richmond, Va., (polydimethyl siloxane/dibutyl tin diacetate, 0.45 gram DBTDA per 100 grams polydimethyl siloxane rubber mixture, with a molecular weight $M_w$ of approximately 3,500); and fluoroelastomers, such as those sold as VITON®, such as copolymers and terpolymers of vinylidenefluoride, hexafluoropropylene, and tetrafluoroethylene, which are known commercially under various designations as VITON A®, VITON E®, VITON E60C®, VITON E45®, VITON E430®, VITON B910®, VITON GH®, VITON B50®, VITON E45®, and VITON GF®. The VITON® designation is a Trademark of E.I. DuPont de Nemours, Inc. Two known fluoroelastomers are comprised of (1) a class of copolymers of vinylidenefluoride, hexafluoropropylene, and tetrafluoroethylene, known commercially as VITON A®; (2) a class of terpolymers of vinylidenefluoride, hexafluoropropylene, and tetrafluoroethylene, known commercially as VITON B®; and (3) a class of tetrapolymers of vinylidenefluoride, hexafluoropropylene, tetrafluoroethylene, and a cure site monomer, such as VITON GF®, having 35 mole percent of vinylidenefluoride, 34 mole percent of hexafluoropropylene, and 29 mole percent of tetrafluoroethylene with 2 percent cure site monomer. The cure site monomer can be those available from E.I. DuPont de Nemours, Inc. such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomers.

The release layer or layers may be deposited on the layer of the phosphate ester containing mixture as illustrated herein by well known coating processes. Known methods for forming the outer release layer include dipping, spraying such as by multiple spray applications of very thin films, casting, flow-coating, web-coating, roll-coating, extrusion, molding, or the like. Usually it is desirable to deposit the layers by spraying such as by multiple spray applications of very thin films, casting, by web coating, by flow-coating, and more specifically, by laminating.

Specific embodiments will now be described in detail. These examples are intended to be illustrative, and are not limited to the materials, conditions, or process parameters set forth in these embodiments. All parts are percentages by weight of total solids unless otherwise indicated.

EXAMPLE I

One percent (1) by weight of the phosphate ester, STEPFAC® 8180 (a polyethylene glycol monotridecyl ether phosphate with an average mole number of ethoxy of about 3, (one phosphate ester molecule contains three ethoxy groups, —$CH_2CH_2O$—$CH_2CH_2O$—$CH_2CH_2O$—, as determined by NMR), available and obtained from STEPAN Company, Northfield, Ill., was mixed with 84 weight percent of the polyamideimide, VYLOMAX® HR-11NN (15 weight percent solution in N-methylpyrrolidone, $T_g$=300° C., and weight average molecular weight, $M_w$=45,000) as obtained from the Toyobo Company, and 15 weight percent of the carbon black, special black 4 (B.E.T. surface area=180 $m^2$/g, DBP absorption=1.8 ml/g, primary particle diameter=25 nanometers) as obtained from DeGussa Chemicals), followed by ball milling the resulting mixture with 2 millimeter stainless shot in an Attritor for a period of 1 hour.

The above resulting dispersion was then coated on a stainless steel substrate of a thickness of 0.5 millimeter using a known draw bar coating method and subsequently dried at 125° C. for 20 minutes, and then dried at 190° C. for an additional 40 minutes while remaining on the steel substrate.

The resulting dried coating self released instantly and within about 4 seconds, with no outside aids or tools, from the stainless steel substrate, and an about 100 micron thick intermediate transfer member film resulted where the weight ratio of the polyamideimide/carbon black/phosphate ester STEPFAC® 8180 was 84/15/1 based on the above initial mixture amounts.

EXAMPLE II

The process of Example I was repeated except that the phosphate ester of the coating mixture of Example I was replaced with POLYSTEP® P-13 (a tridecyl alcohol ethoxylate phosphate with an average mole number of ethoxy of about 12), available and obtained from STEPAN Company, Northfield, Ill. The dried coating self released in 4 seconds, with no outside aids or tools, from the stainless steel substrate, and an about 100 micron thick intermediate transfer member film resulted where the ratio of the PAI/carbon black/phosphate ester POLYSTEP® P-13 was 84/15/1.

EXAMPLE III

The process of Example I was repeated except that the phosphate ester of the coating mixture of Example I was replaced with POLYSTEP® P-34 (a nonylphenol ethoxylate phosphate with an average mole number of ethoxy of about 10), available and obtained from STEPAN Company, Northfield, Ill. The dried coating self released, in 5 seconds, with no outside aids or tools, from the stainless steel substrate, and an about 100 micron thick intermediate transfer member film resulted where the ratio of the PAI/carbon black/phosphate ester POLYSTEP® P-34 was 84/15/1.

EXAMPLE IV

One tenth of a percent (0.1) of the phosphate ester, POLYSTEP® P-34 (a nonylphenol ethoxylate phosphate with an average mole number of ethoxy of about 10), available from STEPAN Company, Northfield, Ill., was mixed with 84.9 weight percent of the polyamideimide, VYLOMAX® HR-11NN (a 15 weight percent solution in N-methylpyrrolidone, $T_g$=300° C., and $M_w$=45,000) as obtained from Toyobo Company, and 15 weight percent of the carbon black, special black 4 (B.E.T. surface area=180 $m^2$/g, DBP absorption=1.8 ml/g, primary particle diameter=25 nanometers) as obtained from DeGussa Chemicals), followed by ball milling the resulting mixture with 2 millimeter stainless shot in an Attritor for 1 hour.

The above resulting dispersion was then coated on a stainless steel substrate of a thickness of 0.5 millimeter using the known draw bar coating method and subsequently dried at 125° C. for 20 minutes, and then at 190° C. for an additional 40 minutes while remaining on the steel substrate.

The resulting dried coating self released in 4 seconds, with no outside aids or tools, from the stainless steel substrate, and an about 100 micron thick intermediate transfer member film resulted where the ratio of the PAI/carbon black/phosphate ester POLYSTEP® P-34 was 84.9/15/0.1.

COMPARATIVE EXAMPLE 1

The process of Example IV was repeated except that the phosphate ester of the coating mixture of Example IV was omitted and where the final coating after drying of the polyamideimide and carbon black did not release from the steel substrate even after immersing in water for 48 hours and hand rubbing. The resulting PAI intermediate transfer member film comprised PAI/carbon black in a ratio of 85/15.

Surface Resistivity Measurement

The above ITB members of Examples I, II, III, IV and Comparative Example 1, were measured for surface resistivity (averaging four to six measurements at varying spots, 72° F./50 percent room humidity) using a High Resistivity Meter (Hiresta-Up MCP-HT450 from Mitsubishi Chemical Corp.); Youngs Modulus for two of the intermediate transfer belts, and coating release characteristics. The results are provided in Table 1.

TABLE 1

| | Surface resistivity (ohm/square) |
|---|---|
| Comparative Example 1, PAI/carbon black = 85/15 | $4.8 \times 10^{10}$ |
| Example I, PAI/carbon black/STEPFAC ® 8180 = 84/15/1 | $6.1 \times 10^{10}$ |
| Example II, PAI/carbon black/POLYSTEP ® P-13 = 84/15/1 | $7.6 \times 10^{10}$ |
| Example III, PAI/carbon black/POLYSTEP ® P-34 = 84/15/1 | $5.2 \times 10^{10}$ |
| Example IV, PAI/carbon black/POLYSTEP ® P-34 = 84.9/15/0.1 | $6.0 \times 10^{10}$ |

Young's Modulus Measurement

The above ITB members of Comparative Example 1 and Example IV were measured for Young's modulus following the known ASTM D882-97 process. An ITB sample of Comparative Example 1 and Example IV (0.5 inch×12 inch) was placed in the measurement apparatus, the Instron Tensile Tester, and then elongated at a constant pull rate until breaking. During this time, there was recorded the resulting load versus the sample elongation. The modulus was calculated by taking any point tangential to the initial linear portion of this curve and dividing the tensile stress by the corresponding strain. The tensile stress was given by the load divided by the average cross sectional area of each of the test samples.

The Young's modulus of the Example IV ITB's comprising the phosphate ester release agent was measured to be about 5,100 MPa (Mega Pascal), while that of the Comparative Example 1 ITB was about 5,500 MPa. Thus, incorporation of the phosphate ester release agent into the ITB had no detrimental effect on the Example IV intermediate transfer member mechanical properties.

The Example I and IV, intermediate transfer belts were quickly, in 4 seconds, released from the stainless steel metal substrate versus no release of the Comparative Example 1 coating from the stainless steel substrate.

The above prepared intermediate transfer members may be deposited on a supporting substrate, such as a polyimide as illustrated herein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member consisting of a solid mixture of a polyamideimide, a phosphate ester and a conductive component which mixture contains thereon a xerographic toner developed image for subsequent transfer to a substrate, said toner developed image originating from a photoconductor, wherein said phosphate ester is selected from the group consisting of an alkyl alcohol ethoxylate phosphate, an alkyl phenol ethoxylate phosphate, an alkyl polyethoxyethanol phosphate, and an alkylphenoxy polyethoxyethanol phosphate; said conductive component is a carbon black, a metal oxide, or a polyaniline; and said polyamideimide is selected from the group consisting one of the following formulas/structures where n represents the number of repeating segments of from about 20 to about 1,000, and wherein the ratio of said polyamideimide to said conductive component to said phosphate ester is 85/14.9/0.1, 95/4.5/0.5, 79/20/1, or 78/1814

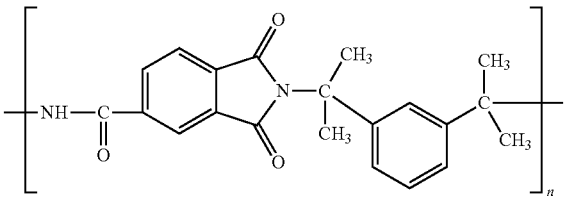

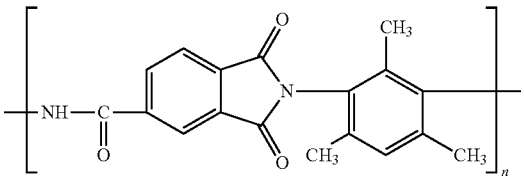

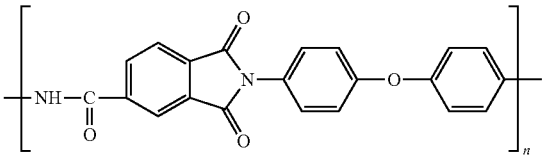

-continued

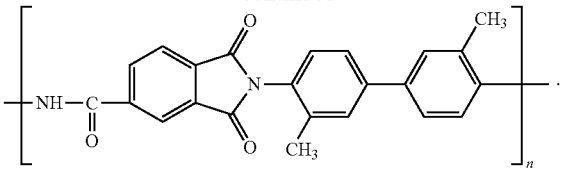

2. An intermediate transfer member in accordance with claim 1 wherein the conductive component is a carbon black, the phosphate ester is a tridecyl alcohol ethoxylate phosphate, a polyethylene glycol monotridecyl ether phosphate, or a nonylphenol ethoxylate phosphate, and n of the polyamideimide is from about 50 to about 500.

3. An intermediate transfer member in accordance with claim 1 wherein n is from about 150 to about 375.

4. An intermediate transfer belt consisting of a mixture of a poyamideimide, a phosphate ester selected from the group consisting of an alkyl alcohol ethoxylate phosphate, an alkyl phenol ethoxylate phosphate, an alkyl polyethoxyethanol phosphate, and an alkylphenoxy polyethoxyethanol phosphate present in an amount of from about 0.1 to about 7 weight percent, and carbon black and wherein said polyamideimide is present in an amount of from about 60 to about 97 weight percent, and said carbon black is present in an amount of from about 3 to about 40 weight percent, and the total thereof is about 100 percent, and wherein said mixture contains thereon a xerographic toner developed image for subsequent transfer to a substrate, said toner developed image originating from a photoconductor.

5. An intermediate transfer bait in accordance with claim 4 wherein said polyamideimide is present in an amount of from about 80 to about 95 weight percent, said phosphate ester is present in an amount of from about 0.5 to about 2 weight percent, and said carbon black is present in an amount of from about 5 to about 20 weight percent, and the total thereof is 100 percent.

6. An intermediate transfer belt in accordance with claim 4 wherein the ratio of said polyamideimide to said carbon black to said phosphate ester is 85/14.9/0.1, 95/4.5/0.5, 79/20/1, or 78/18/4.

* * * * *